US008447044B2

(12) United States Patent
Nongpiur et al.

(10) Patent No.: US 8,447,044 B2
(45) Date of Patent: May 21, 2013

(54) ADAPTIVE LPC NOISE REDUCTION SYSTEM

(75) Inventors: Rajeev Nongpiur, Burnaby (CA); Phillip A. Hetherington, Moody (CA)

(73) Assignee: QNX Software Systems Limited, Kanata, Ontario (CA)

( * ) Notice: Subject to any disclaimer, the term of this patent is extended or adjusted under 35 U.S.C. 154(b) by 1298 days.

(21) Appl. No.: 11/804,577

(22) Filed: May 17, 2007

(65) Prior Publication Data

US 2008/0285773 A1 Nov. 20, 2008

(51) Int. Cl.
*G10K 11/16* (2006.01)

(52) U.S. Cl.
USPC ..... 381/71.1; 381/71.11; 381/98; 381/94.2; 381/103; 379/406.04

(58) Field of Classification Search
USPC ..... 381/94.1, 71.1, 71.7, 71.14, 106, 381/317, 71.11, 71.12, 94.7, 94.8, 302, 86, 381/83, 92, 93, 94.2, 94.3, 97, 98, 96, 99, 381/100, 103, 121, 120, 318, 320; 367/178, 367/901, 124, 129; 704/E19.028, 207, 233, 704/219, 262; 700/94; 379/392.01, 388.07, 379/406.04, 406.05, 406.08; 455/501, 63.1, 455/67.13, 570, 114.2, 222, 278.1, 283, 296
See application file for complete search history.

(56) References Cited

U.S. PATENT DOCUMENTS

| | | | | |
|---|---|---|---|---|
| 4,243,935 | A * | 1/1981 | McCool et al. | 324/76.35 |
| 5,208,837 | A * | 5/1993 | Richey | 375/350 |
| 5,548,681 | A * | 8/1996 | Gleaves et al. | 704/233 |
| 5,704,000 | A * | 12/1997 | Swaminathan et al. | 704/207 |
| 6,230,123 | B1 * | 5/2001 | Mekuria et al. | 704/226 |
| 6,937,980 | B2 * | 8/2005 | Krasny et al. | 704/231 |
| 7,146,013 | B1 * | 12/2006 | Saito et al. | 381/92 |
| 7,174,022 | B1 * | 2/2007 | Zhang et al. | 381/92 |
| 2004/0165736 | A1 | 8/2004 | Hetherington et al. | |
| 2006/0095256 | A1 * | 5/2006 | Nongpiur et al. | 704/207 |
| 2006/0217976 | A1 * | 9/2006 | Gao et al. | 704/233 |

FOREIGN PATENT DOCUMENTS

JP 10023590 A * 1/1998

OTHER PUBLICATIONS

*Linear Predictive Coding* by Jeremy Bradbury, dated Dec. 5, 2000.

* cited by examiner

*Primary Examiner* — Vivian Chin
*Assistant Examiner* — Leshui Zhang
(74) *Attorney, Agent, or Firm* — Brinks Hofer Gilson & Lione

(57) ABSTRACT

A noise suppression system reduces low-frequency noise in a speech signal using linear predictive coefficients in an adaptive filter. A digital filter may update or adapt a limited set of linear predictive coefficients on a sample-by-sample basis. The linear predictive coefficients may be used to provide an error signal based on a difference between the speech signal and a delayed speech signal. The error signal represents an enhanced speech signal having attenuated and normalized low-frequency noise components.

19 Claims, 9 Drawing Sheets

ADAPTIVE LPC NOISE REDUCTION SYSTEM

BACKGROUND OF THE INVENTION

1. Technical Field

This disclosure relates to noise suppression. In particular, this disclosure relates to reducing low-frequency noise in speech signals.

2. Related Art

Users access various systems to transmit or process speech signals in a vehicle. Such systems may include cellular telephones, hands-free systems, transcribers, recording devices and voice recognition systems.

The speech signal includes many forms of background noise, including low-frequency noise, which may be present in a vehicle. The background noise may be caused by wind, rain, engine noise, road noise, vibration, blower fans, windshield wipers and other sources. The background noise tends to corrupt the speech signal. The background noise, especially low-frequency noise, decreases the intelligibility of the speech signal.

Some systems attempt to minimize background noise using fixed filters, such as analog high-pass filters. Other systems attempt to selectively attenuate specific frequency bands. The fixed filters may indiscriminately eliminate desired signal content, and may not adapt to changing amplitude levels. There is a need for a system that reduces low-frequency noise in speech signals in a vehicle.

SUMMARY

A noise suppression system reduces low-frequency noise in a speech signal using linear predictive coefficients in an adaptive filter. A digital filter may update or adapt a limited set of linear predictive coefficients on a sample-by-sample basis. The linear predictive coefficients may model the human vocal tract. The linear predictive coefficients may be used to provide an error signal based on a difference between the speech signal and a delayed speech signal. The error signal may represent an enhanced speech signal having attenuated and normalized low-frequency noise components.

Low-frequency noise, even if lower in amplitude than the speech signal, tends to mask or reduce the intelligibility of speech. The noise suppression system may establish an attenuated amplitude level, and all low-frequency noise components may be programmed to an attenuated level. The attenuated level may represent a normalized or "flattened" signal level.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION OF THE PREFERRED EMBODIMENTS

Figure 1:
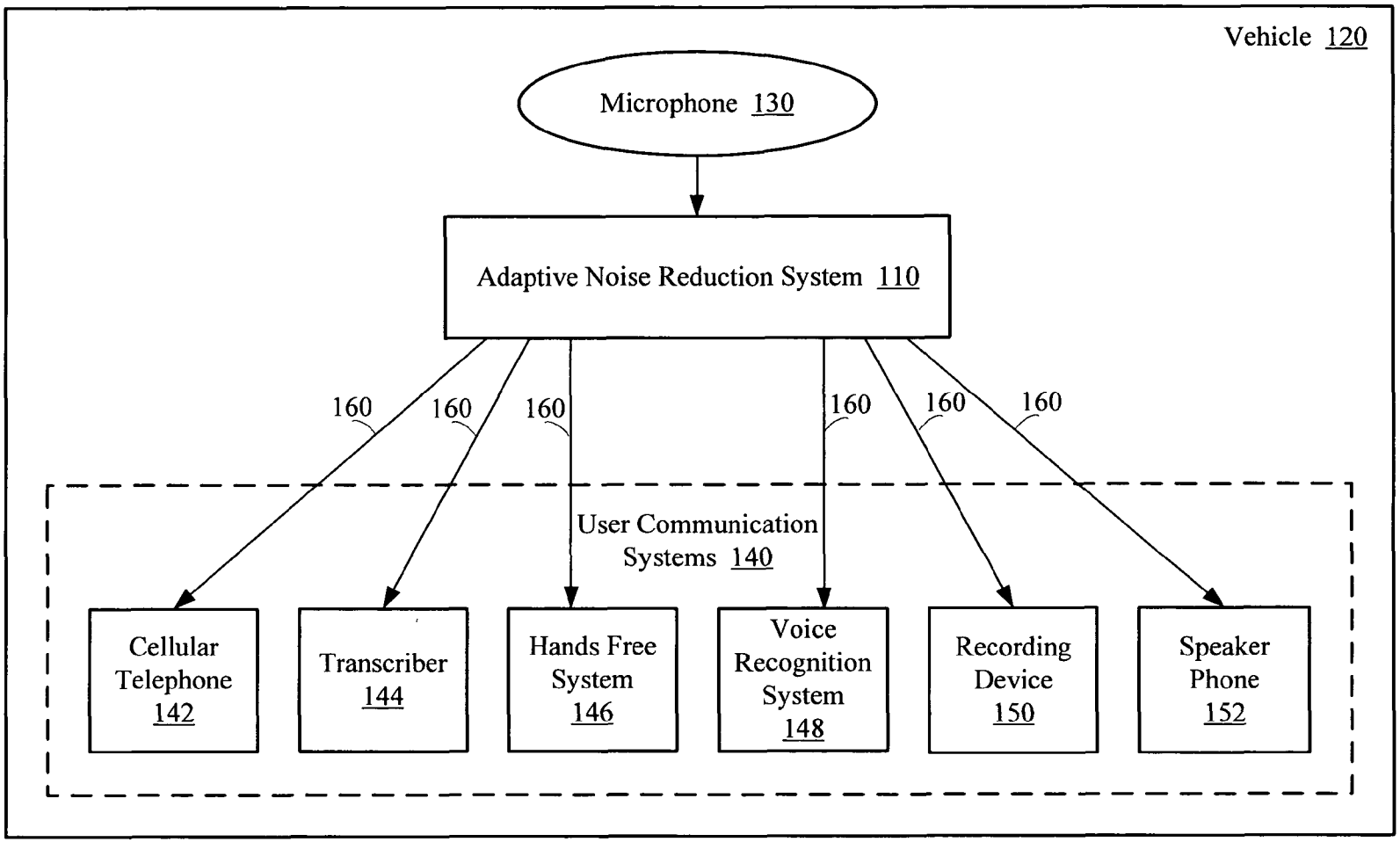
FIG. 1 shows an adaptive noise reduction system in a vehicle environment.

FIG. 1 shows an adaptive noise reduction system 110 in a vehicle environment 120. The adaptive noise reduction system 110 may receive speech signals from a device that converts sound into operational signals, such as a microphone 130 in a user system 140. The user system 140 may be a device that receives speech signals where the fidelity of the speech signal is considered. The user systems 140 may include a cellular telephone 142, a transcriber 144, a hands-free system 146, a voice recognition system 148, a recording device 150, a speakerphone or other communication system. The adaptive noise reduction system 110 may be interposed between the microphone 130 and the circuitry of the specific user system 140, or may be incorporated into the specific user system 140. The adaptive noise reduction system 110 may be used in a user system where speech signals are processed or transmitted. The respective user systems 140 may receive an output signal 160 from the adaptive noise reduction system 110.

The output signal 160 of the adaptive noise reduction system 110 represents enhanced speech signals having reduced noise levels, where low-frequency noise components have been "flattened." A flattened signal may have frequency components that have been normalized or reduced in amplitude to some predetermined value across a frequency band of interest. For example, if a speech signal includes low-frequency components (noise) in the zero to about 500 Hz region, the amplitude of each frequency component may be set equal to a predetermined amplitude to reduce the average amplitude of the low-frequency signals.

Figure 2:
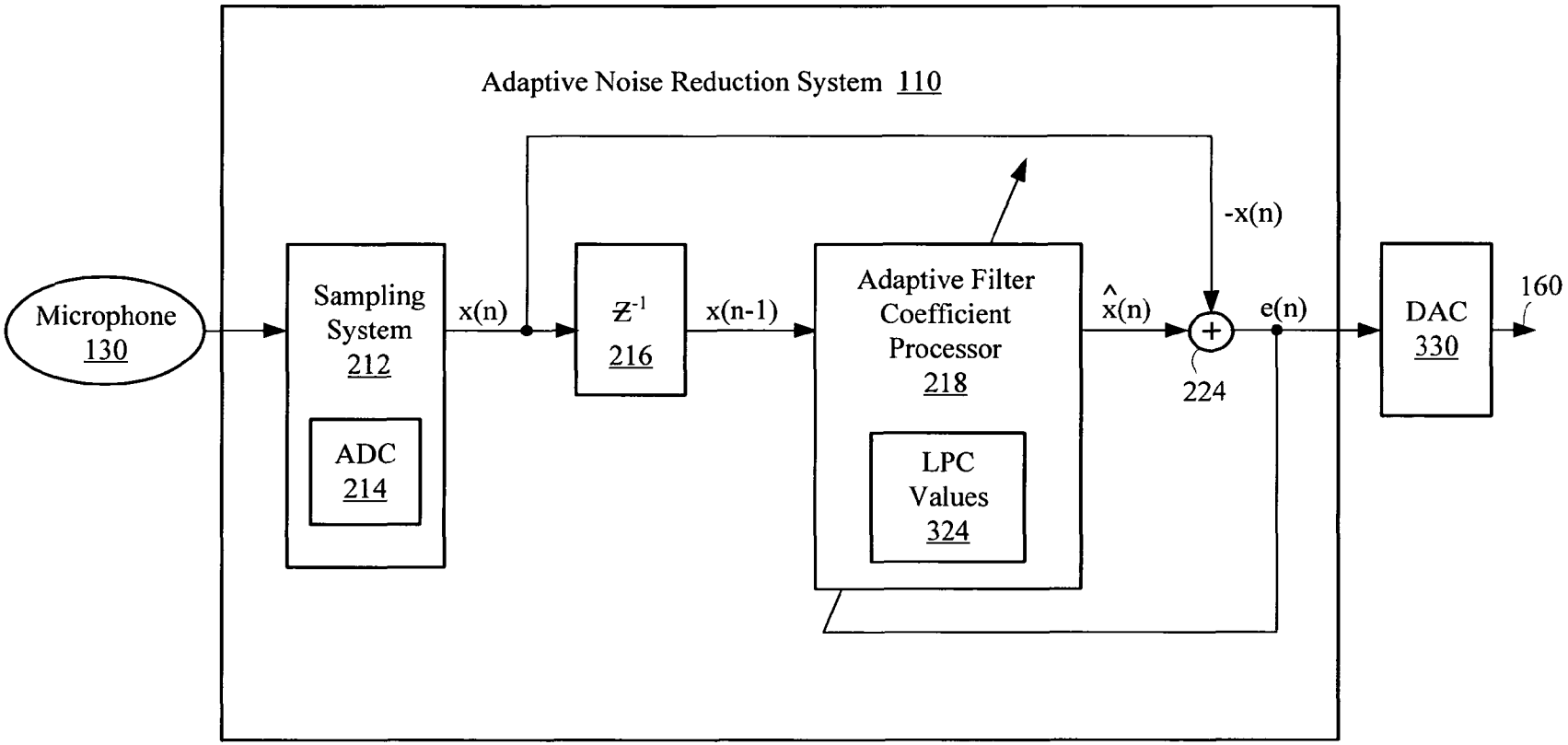
FIG. 2 shows an adaptive noise reduction system.

FIG. 2 shows the adaptive noise reduction system 110, which may include a sampling system 212. The sampling system 212 may couple the microphone 130 to the adaptive noise reduction system 110. The sampling system 212 may receive an operational signal from the microphone 130 representing speech, and may convert the signal into digital form at a selected sampling rate. The sampling rate may be selected to capture any desired frequency content. For speech, the sampling rate may be approximately 8 kHz to about 22 kHz. The sampling system 212 may include an analog-to-digital converter (ADC) 214 to convert the analog speech signals from the microphone 130 to sampled digital signals.

The sampling system 212 may output a continuous sequence of sampled speech signals x(n) to first delay logic 216. The first delay logic 216 may delay the sampled speech signal x(n) by one sample, and may feed the delayed speech signal x(n−1) to an adaptive filter coefficient processor 218. The adaptive filter coefficient processor 218 may be implemented in hardware and/or software, and may include a digital signal processor (DSP). The DSP 218 may execute instructions that delay an input signal one or more additional times, track frequency components of a signal, filter a signal, and/or attenuate or boost an amplitude of a signal. Alternatively, the adaptive filter coefficient processor or DSP 218 may be implemented as discrete logic or circuitry, a mix of discrete logic and a processor, or may be distributed over multiple processors or software programs.

The adaptive filter coefficient processor 218 may process the continuous stream of speech signals x(n) and produce an estimated signal $\hat{x}(n)$. Summing logic 224 may sum the estimated signal $\hat{x}(n)$ and an inverted sampled speech signal −x(n) to produce an error signal e(n). The summing logic 224 may include an adder, comparator or other logic and circuitry. To provide the error signal e(n), which may be a difference signal, the sampled speech signal x(n) may be inverted prior to the summing operation. In FIG. 2, an inversion is shown by the minus sign preceding "x(n)." The error signal e(n) may then be used to calculate and adaptively update a plurality of linear predictive coefficient values 324 (LPC values).

Figure 3:
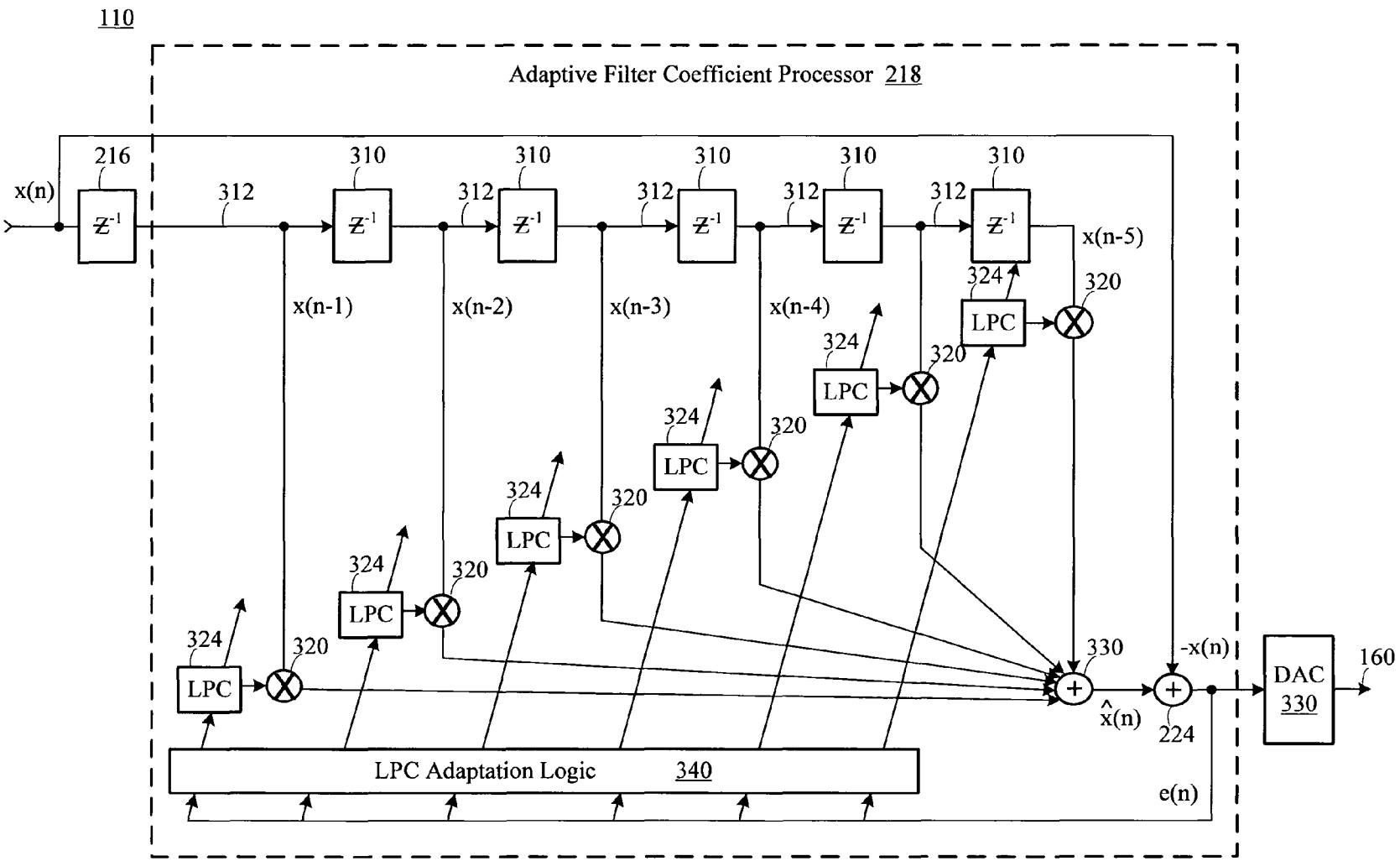
FIG. 3 shows an adaptive filter coefficient processor.

FIG. 3 shows the adaptive filter coefficient processor 218 in greater detail. The adaptive filter coefficient processor 218 may include sequentially coupled delay logic 310. An output signal 312 of each delay logic 310 may feed the input of the subsequent stage. Multiplier logic 320 may multiply the output signal 312 of each delay logic circuit 310 by the respective LPC value 324. Summing node logic 330 may sum the output of the respective multipliers 320 to implement a sum of products operation and provide the estimated signal $\hat{x}(n)$.

The adaptive filter coefficient processor 218 may include five delay logic blocks 310, not including the first delay logic circuit 216. The number of LPC values 324 may be one less than the number of delay circuits. Accordingly, FIG. 3 shows six LPC values 324 corresponding to the five delay logic circuits 310. This indicates that the adaptive filter coefficient processor 218 shown in FIG. 3 may have a length of six or may be a sixth order filter. However, the adaptive filter coefficient processor 218 may dynamically modify the filter order, and thus the number of LPC values, to adapt to a changing environment.

The adaptive filter coefficient processor 218 may be a finite impulse response (FIR) time-domain active filter or another filter. The adaptive filter coefficient processor 218 may use a linear predictive approach to model the vocal tract of a speaker. The LPC values 324 may be updated on a sample-by-sample basis, rather than a block approach. However, in some implementations, a block approach may be used.

Some linear predictive coding techniques use a block approach to model the human vocal tract. Such linear predictive coding techniques may attempt to model the human speech to compress and encode the speech to reduce the amount of data transmitted. Rather than transmitting actual processed speech samples, such as digitized speech, some linear predictive systems transmit the coefficients along with limited instructions. The receiving system may then use the transmitted coefficients to synthesize the original speech. Such linear predictive systems may effectively "compress" the speech because the transmitted coefficients represent less data than the actual digitized speech samples. The limited instructions transmitted along with the coefficients may include instructions indicating whether a coefficient corresponds to a voiced or unvoiced sound. However, some linear predictive systems may require about one hundred to about one-hundred and fifty coefficients to accurately model speech and produce realistic sounding speech. Use of an insufficient number of coefficients may result in a "mechanical" sounding voice.

Some linear predictive coding systems may use the Levinson-Durbin recursive process to calculate the coefficients on a block-by-block basis. A predetermined number of samples are received before the block is processed. A linear predictive system using the Levinson-Durbin algorithm may require one-hundred coefficients (or more). This may necessitate use of a corresponding block size of equal value, for example, one-hundred samples (or more). Some block approaches provide an "average" for the coefficients based on the entire block, rather than on a per sample basis. Accordingly, inaccuracies may arise due to the variation in the speech sample within the block.

The adaptive filter coefficient processor 218 may adaptively calculate the LPC values on a sample-by-sample basis. That is, for each new speech sample, the adaptive filter coefficient processor 218 may update all of the LPC values. Thus, the LPC values may quickly adapt to actual changes in the speech samples. The LPC values calculated on a sample-by-sample basis may be more effective in tracking any rapid variations in the vocal tract compared to the block approach. The adaptive filter coefficient processor 218 may dynamically update the LPC values on a sample-by-sample basis to attempt to minimize the error signal, e(n), which may be fed back to the adaptive filter coefficient processor 218.

The error signal, e(n), may be a difference between the estimated signal $\hat{x}(n)$ and the sampled speech signal x(n), which has been inverted. The error signal e(n) may contain the actual processed speech samples and may represent the output to a subsequent stage. In that regard, the error signal e(n) may not contain the LPC values or coefficients as do the outputs of other predictive systems. Because the error signal e(n) may represent the actual digitized speech sample as processed, it cannot approach zero. The first delay logic 216, in part, and use of a low number of LPC values may prevent the estimated signal $\hat{x}(n)$ from precisely duplicating the sampled speech signal x(n). Accordingly, the value of e(n) may not approach zero.

Because few LPC values are used, the error signal e(n) may be maintained at a sufficiently high value. Thus, the vocal tract is modeled by the LPC values 324. The adaptive filter coefficient processor 218 models an "envelope" of the speech spectrum. This effectively preserves the speech information in the error signal e(n). Any number of LPC values may be used, and the number of such values (and associated delays) may be changed dynamically. For example, between two and twenty LPC values may be used. The error signal e(n) representing the processed speech signal may be converted back to another format, such as an analog signal format, by a digital-to-analog converter (DAC) 330. The output of the DAC 330 may provide the processed or enhanced output signal 160 to the user system 140.

An LPC adaptation circuit or logic 340 may minimize the error signal e(n) by minimizing the difference between the estimated signal $\hat{x}(n)$ and the sampled speech signal x(n) based on a least-squares type of process. The LPC adaptation circuit 340 may use other processes, such as recursive least-squares, normalized least mean squares, proportional least mean squares and/or least mean squares. Many other processes may be used to minimize the error signal e(n). Further variations of the minimization may be used to ensure that the output does not diverge.

To minimize the error signal, e(n), the LPC adaptation logic 340 may adaptively update the LPC values on a sample-by-sample basis. The error signal, e(n), is given by the equation:

$$e(n)=\hat{x}(n)-x(n) \tag{1}$$

where:

$$\hat{x}(n)=\sum_{i=1}^{N} a_i x(n-i) \tag{2}$$

and where:

$a_1, a_2, \ldots, a_N$ are the linear prediction coefficients and N is the LPC order. The LPC values may be estimated by solving for $a_i$ such that the mean square of the error, e(n), may be minimized. The solution may be expressed as a FIR adaptive filter where x(n) is the desired signal, $\hat{x}(n)$ is the estimated signal, $a_1, a_2, \ldots, a_N$ are the adaptive filter coefficients, and x(n−i) is the reference signal provided to the adaptive filter.

Figure 4:
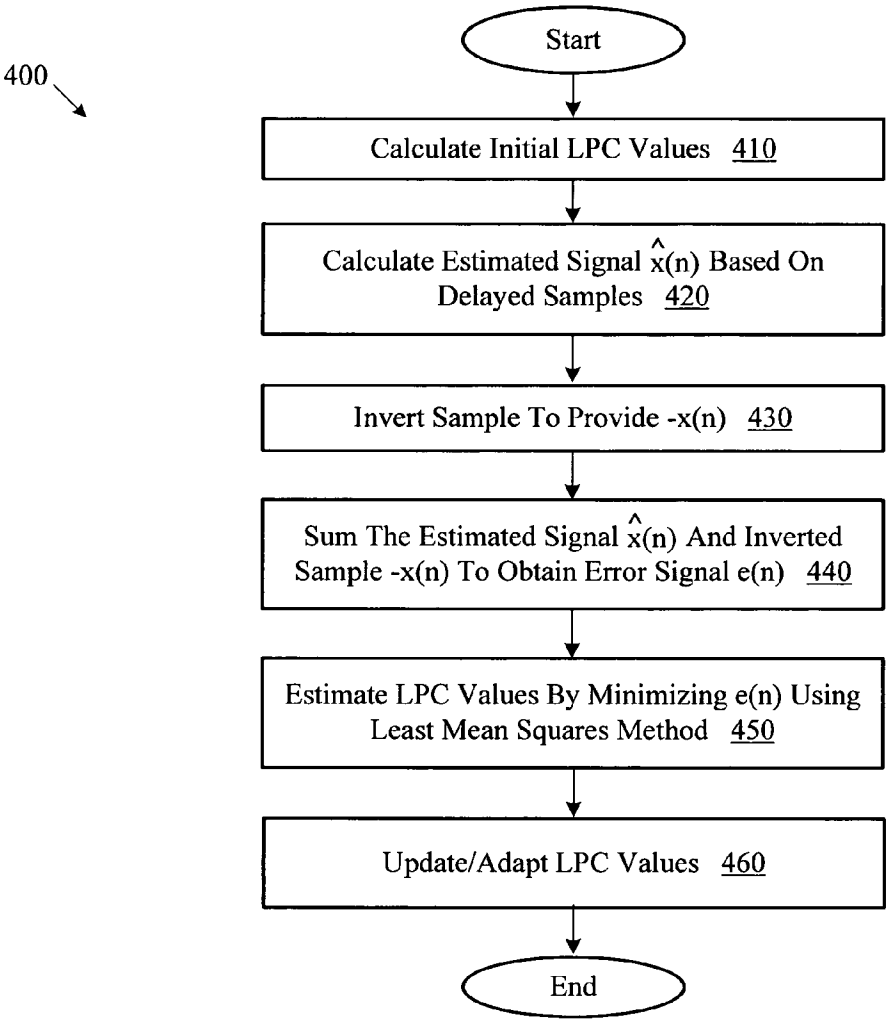
FIG. 4 is a flow diagram showing adaptation of the LPC values.

FIG. 4 show the acts 400 that the adaptive coefficient processor 218 may take to update the LPC values. Initial LPC values may first be calculated (Act 410). The adaptive coefficient processor 218 may then calculate the estimated signal $\hat{x}(n)$ based on the delayed samples (Act 420). The adaptive coefficient processor 218 may then invert the sampled signal to obtain an inverted signal −x(n) (Act 430). The error signal e(n) may be obtained by summing the estimated signal and the inverted signal (Act 440). The adaptive coefficient processor 218 may minimize the error signal e(n) using a form of least mean squares to estimate the LPC values (Act 450). The LPC values 324 may be updated with the estimated LPC values (Act 460) so that the LPC values adapt to a changing input signal.

Figure 5:
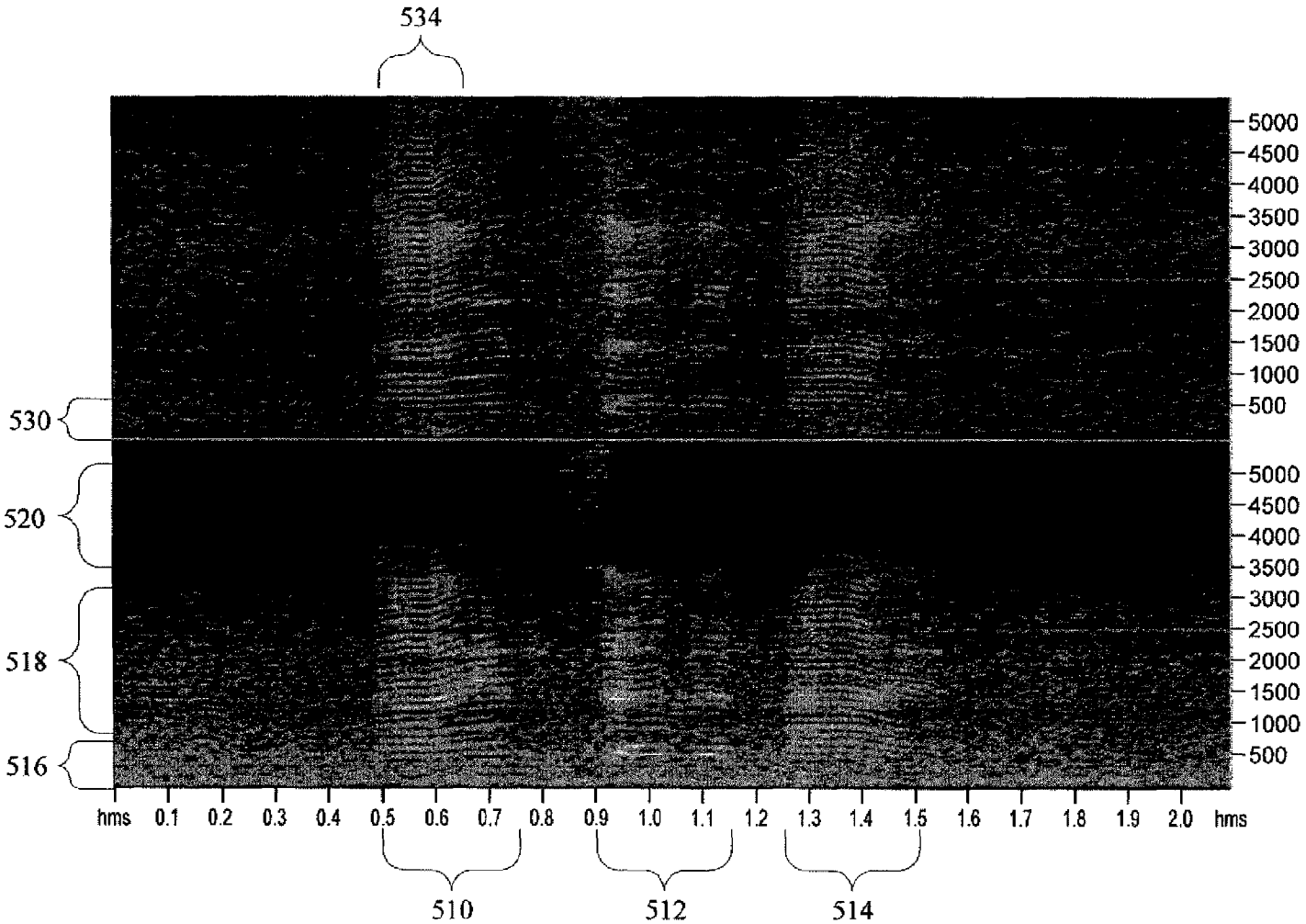
FIG. 5 is a spectrograph showing an unprocessed speech waveform in a lower panel. An upper panel shows the same speech waveform processed by the adaptive noise reduction system.

FIG. 5 is a spectrograph of a speech waveform in both upper and lower panels. Time is shown on the x-axis, frequency is shown on the y-axis, and amplitude is indicated by the color of the signal (if a color drawing) or by the intensity or grayscale (if a black and white drawing). Both panels show three speech signals. For example, a first speech signal 510 begins at about time=0.5 ms and ends at about time=0.75 ms. A second speech signal 512 begins at about time=0.9 ms and ends at about time=1.15 ms. And a third speech signal 514 begins at about time=1.25 ms and ends at about time=1.5 ms.

The lower panel shows the speech signals 510, 512 and 514 corrupted by low-frequency noise 516 in the about 0-500 Hz frequency range. This appears for the duration of the signals from about time=0 to about time=2 ms. The amplitude of the speech signals 510, 512 and 514 is assumed to be higher than the amplitude of the noise signal 516.

The amplitude of the noise drops to a lower noise level shown by reference numeral 518 during the interval from time=0.0 ms to about time=0.5 ms in the 500-3500 Hz frequency range. The amplitude of the noise drops again to a lower background noise level shown by reference numeral 520 from time=0.0 ms to about time=0.5 ms in the 3500-5000 Hz frequency range. The characteristics of the noise signal 516 beyond time=0.5 ms are not addressed.

The upper panel shows the same speech waveforms shown in the lower panel, but processed with the adaptive noise reduction system 110 of FIGS. 1-3. The upper panel shows that the adaptive noise reduction system 110 has significantly reduced the amount of low-frequency noise 530. That is, its amplitude of the low-frequency noise 530 has been reduced and normalized or flattened.

The LPC values 324 may be updated on a sample-by-sample basis so that the system may adapt quickly to a changing input signal. The adaptive filter coefficient processor 218 may attempt to flatten or normalize the signal across a portion or across the entire frequency spectrum. Because of the way the human brain perceives speech, the low-frequency noise, even if lower in amplitude than the speech signal, tends to mask out the speech, thus degrading its quality.

The flatness level may be selected in a way such that the spectral envelope of the speech portion of both the processed and unprocessed signals are at similar levels. The level of the flattened spectrum may also be adjusted to approximate the average of the noise spectrum envelope of the unprocessed signal. Because the adaptive filter coefficient processor 218 may flatten or normalize all components across the entire frequency spectrum, both the low-frequency noise 516 and the speech signals 510, 512 and 514 may be flattened. Thus, the low-frequency content of the speech signal may be somewhat degraded.

As an example, assume that the noise signal 516 ranges in amplitude from 0 dB to −20 dB. Note also that the noise signal 516 overlaps the speech signals 510, 512 and 514, which speech signals have a higher average amplitude than the noise signal 516. Based on the amplitude of the envelope, the adaptive noise reduction system 110 may select a flattened or attenuated level, for example, −12 dB. Thus, the amplitude of all signals at a particular time is set to −12 dB. Accordingly, higher amplitude noise components at 0 dB may be lower by 12 db (from 0 dB to −12 dB), but some lower amplitude noise components at −20 dB may be raised in amplitude by 8 dB (from −20 dB to −12 dB). As shown in the upper panel, the average amplitude of the noise signal 530 has been reduced.

However, the speech signals 510, 512 and 514, which have a higher average energy level than the noise signal, begins at about time=0.5 ms. The LPC values 324 may adapt to the changing input signal caused by the presence of the speech signals 510, 512 and 514. Accordingly, all of the components may be normalized or flattened. This may tend to undesirably raise the weak harmonic components of the speech signals to a higher amplitude level, thereby increasing the noise energy and also changing the format structure of the speech signal. For example, the upper panel shows that weak amplitude harmonic components 534 of the speech signal 510 in the 3500 Hz to 5000 Hz range have been undesirably boosted in amplitude. Such high-frequency harmonic artifacts 534 of the speech signal may have ranged in amplitude from −20 db to −10 db before processing, for example. However, after processing, the flattening of the spectrum may result in an increase of the above-mentioned level by 10 dB to 12 dB.

The overall quality of the speech signal shown in the upper panel is improved due to the reduction of the low-frequency noise signal 530. The low-frequency components removed or flattened by the adaptive noise reduction system 110 may represent wind, rain, engine noise, road noise, vibration, blower fans, windshield wipers and/or other undesired signals that tend to corrupt the speech signal.

Variations in signal amplitude may be effectively handled because the adaptive noise reduction system 110 may continuously adapt to the input signal on a sample-by-sample basis. For example, if the amplitude of the noise signal increases suddenly, the adaptive filter coefficient processor 218 may more aggressively attenuate the noise signal to reduce the high amplitude components and flatten the overall amplitude. For example, when the signal is corrupted with high amplitude, low-frequency noise, the adaptive filter may adapt such that the frequency response of the inverse of the LPC values may correspond to the shape of the noise spectrum. However, filtering the signal using the LPC values, rather than using the inverse of the LPC values, results in flattening the noise spectrum in the signal. For this reason, a fixed or nonadapting filter may not provide a satisfactory response. A fixed or non-adaptive filter may always attenuate an input signal by the same amount, regardless of the amplitude of the input signal.

Figure 6:
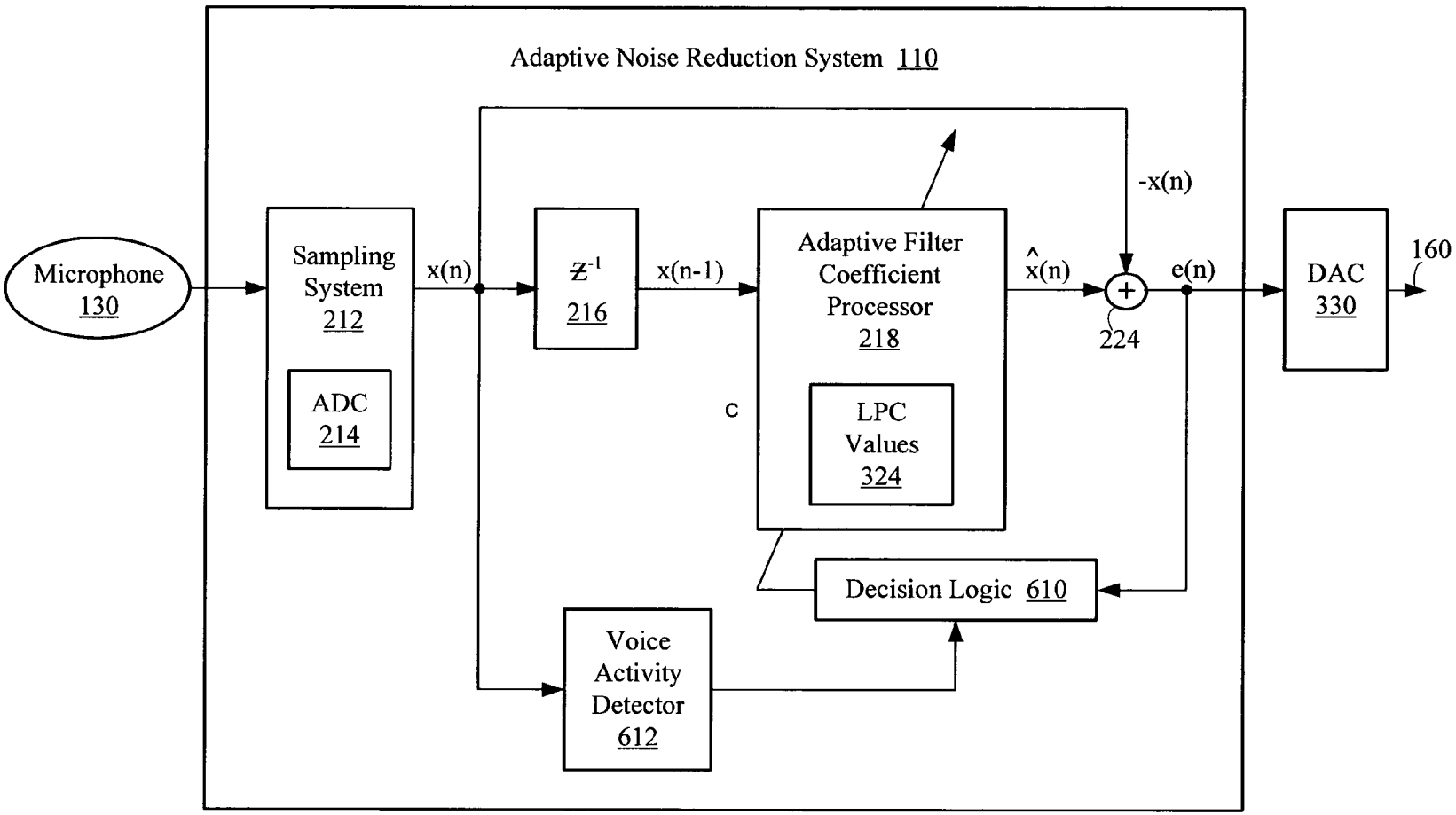
FIG. 6 shows an adaptive noise reduction system having a voice activity detector.

To reduce or eliminate the high-frequency harmonic artifacts 534 shown in the upper panel of FIG. 5, the adaptive noise reduction system 110 may include a decision logic circuit 610 and a voice activity detector (VAD) 612, shown in FIG. 6. The VAD 612 may receive the speech signal prior to sampling to determine if a speech signal is present. The VAD 612 may inform the decision logic 610 whether voice activity is present. The VAD 612 may determine voice activity based on an average value of the input signal. The VAD 612 may measure the energy of the envelope of the input signal. When the energy of the envelope exceeds a predetermined value, for example, twice the average background level, the VAD may issue a signal to the decision logic 610 indicating detection of voice activity. Accurate voice detection assumes that the energy of the speech signal is greater than the energy of the background or noise signal.

A voice activity detector 612 may halt adaptation of the linear predictive coefficients when a speech signal is detected in the presence of noise. Because the linear predictive coefficients may not be updated during the presence of a speech signal, the digital filter may not adapt to the increased energy level of speech signal. Because adaptation may be halted during this time, the amplitude of speech signal across the frequency spectrum may not normalized or flattened.

The decision logic circuit 610 may control the adaptation process of the LPC values 324. The decision logic circuit 610 may prevent adaptation of the LPC values 324 when the VAD 612 detects speech. The LPC values 324 may be maintained at their prior values when a speech signal is detected. In certain applications, the adaptive filter coefficient processor 218 may not adapt or modify the LPC values 324 during voice detection. Conversely, the decision logic circuit 610 may permit normal adaptation of the LPC values 324 when the VAD 612 indicates that a speech signal is not present. However, in some specific applications, some limited form of filter adaptation may occur when speech is detected.

Figure 7:
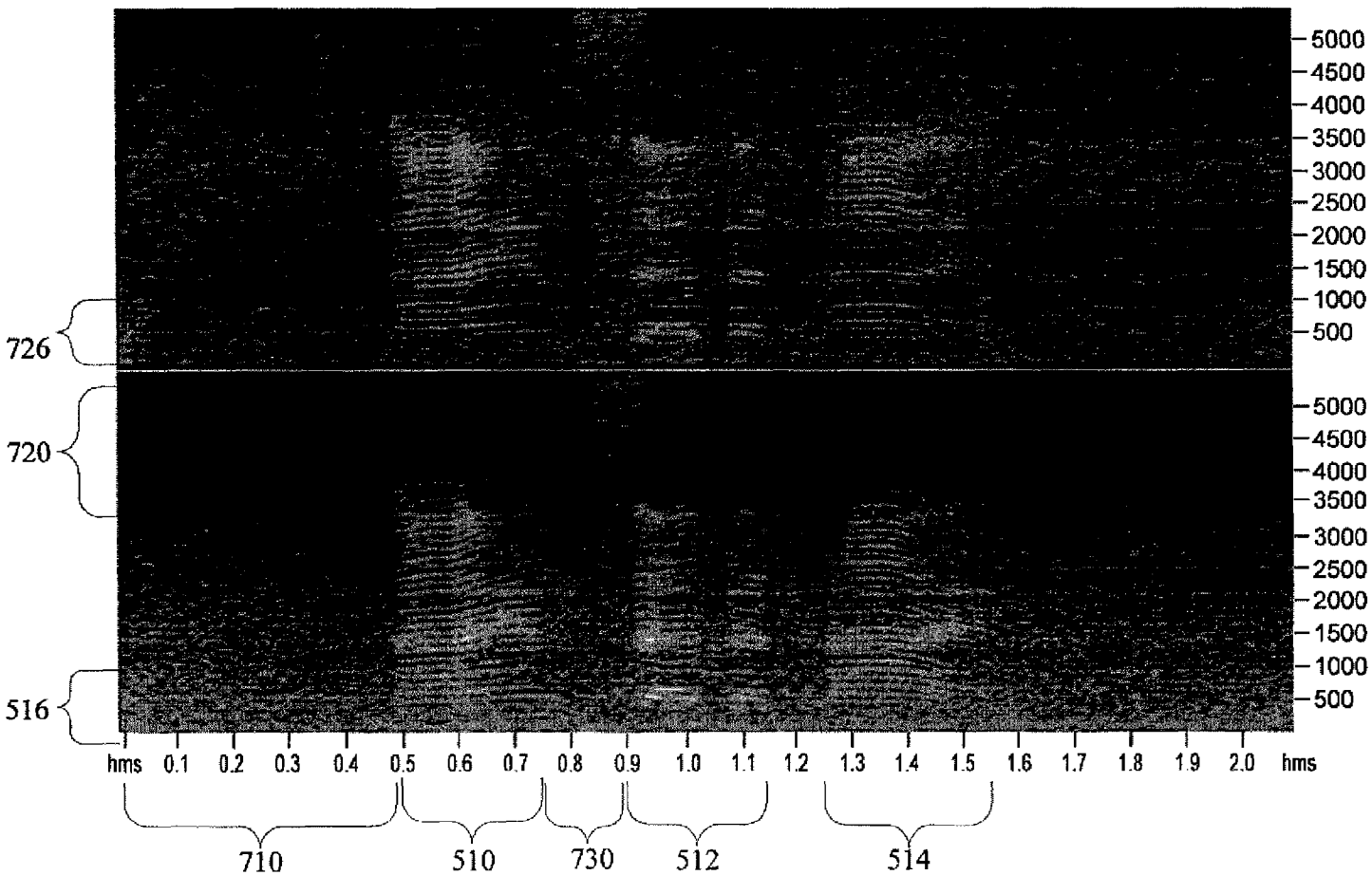
FIG. 7 is a spectrograph showing an unprocessed speech waveform in a lower panel. An upper panel shows the same waveform processed by the adaptive noise reduction system having the voice activity detector.

FIG. 7 is a spectrograph showing a speech waveform in both upper and lower panels. FIG. 7 shows three speech signals 510, 512 and 514 with noise components 516. During presence of noise 516, for example, from time=0 to about 0.5 ms (710), the adaptive noise reduction system 110 adapts and may continuously update the LPC values 324 on a sample-by-sample basis to flatten the signal. However, when the speech signal 510 is detected, the VAD 612 may halt adaptation and modification of the LPC values in some applications. Because the higher energy of the speech signal cannot influence or cause any changes in the LPC values 324, the weak amplitude components 720 of the speech signal 510 in about 3500 Hz to about 5000 Hz range may not be artificially raised. This may prevent formation of the high-frequency speech artifacts 534 shown in FIG. 5.

Accordingly, throughout an entire speech signal 510 segment, the noise signal 516 may be flattened in accordance with the LPC values in effect prior to the beginning of the speech signal 510. Because adaptation is halted during the speech signal 510 in some applications, the integrity of the speech signal is preserved, while eliminating or reducing the noise signal, as shown by reference numeral 726 in the 0-500 Hz frequency range. Adaptation and updating of the LPC values 324 may again begin when the VAD 612 indicates that the speech signal is no longer present, as shown by reference numeral 730 from time=0.75 ms to about time=0.90 ms.

Figure 8:
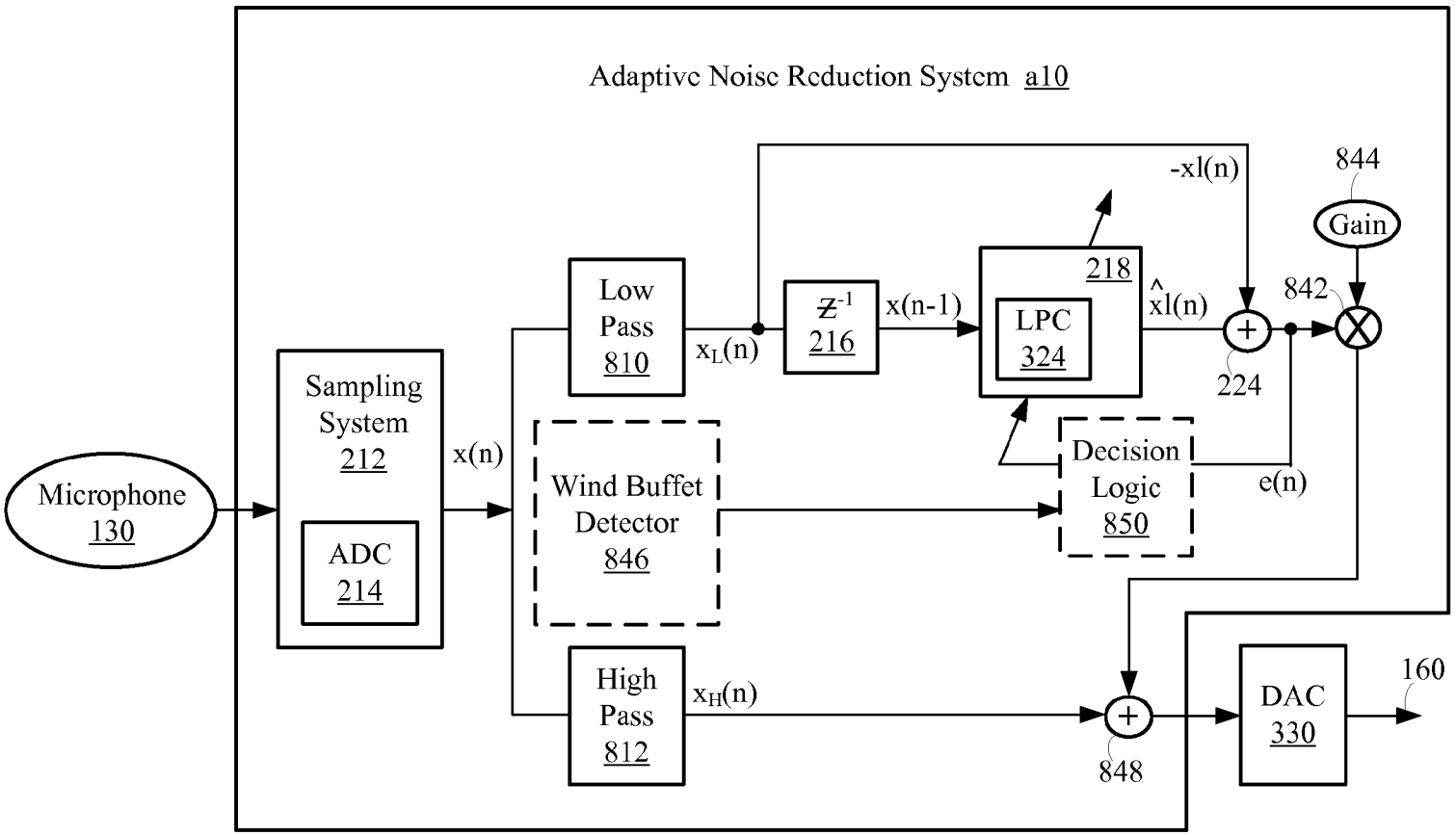
FIG. 8 shows an adaptive noise reduction system having a wind buffet detector.

FIG. 8 shows another aspect of the adaptive noise reduction system 110, and may include a low-pass filter 810 and a high-pass filter 812, both coupled to the sampling system 210. The low-pass filter 810 and the high-pass filter 812 may separate the speech signal x(n) into low-frequency components $x_L(n)$ and high-frequency components $x_H(n)$ for separate processing. Separate processing of low-frequency and high-frequency components may facilitate suppression of wind buffet components that may contain high-amplitude low-frequency noise components.

Because of the way in which the human brain perceives and processes speech, such low-frequency components, even if lower in amplitude than the speech signal, tend to mask the speech signal. Thus, the quality of the speech signal may be greatly improved by reduction or elimination of the wind buffet signals, even if some desirable low-frequency content of the speech signal may also reduced or removed.

The low-pass filter 810 may have a cut-off or cross-over frequency at about 800 Hz so that the first delay logic circuit 216 only receives the low-frequency noise signal $x_L(n)$, which is below 800 Hz. Similarly, the high-pass filter 812 may have a cut-off or cross-over frequency at about 800 Hz so that the filter output summing circuit 848 may receive only the high-frequency signal $x_H(n)$, which is above 800 Hz.

The low-frequency noise signal $x_L(n)$ may contain high-amplitude low-frequency wind buffet components. The low-frequency noise signal $x_L(n)$ may be processed by the adaptive filter coefficient processor 218 to flatten the low-frequency components, thus reducing or eliminating wind buffet components.

A low-pass gain adjustment circuit 842 may adjust a gain of the error signal e(n) to account for flattening of the signal. The gain adjustment circuit 842 may amplify, attenuate or otherwise modify the error signal e(n) by a variable amount of gain 844. The gain 844 may be adjusted so that the background noise levels of the low-frequency and high-frequency components at the crossover frequency may be approximately equal. A filter output summing circuit 848 may sum the output of the low-pass gain adjustment circuit 842 and an output $x_H(n)$ of the high pass filter 812. The low-frequency wind buffet signals may be flattened or reduced in amplitude by the adaptive filter coefficient processor 218 on a sample-by-sample basis.

The flattened noise spectrum in the low-frequency band provided by the adaptive filter coefficient processor 218 may be at a level that that is much lower than the level of the noise spectrum in the high-frequency band. Thus, to maintain continuity in the noise spectrum, the signal in the low-frequency band may be multiplied by an estimated gain factor 844 so that the spectral level of the noise in the low- and high-frequency bands are the same.

Alternatively, a wind buffet detector 846, shown in dashed lines, may be coupled to a decision logic circuit 850, also shown in dashed lines. The wind buffet detector may be implemented in a similar manner as the wind buffet detection circuitry described in U.S. Patent Application Publication No. US 2004/0165736. U.S. Patent Application Publication No. US 2004/0165736 is incorporated by reference in its entirety.

The wind buffet detector 846 may control the decision logic 850, and may inhibit adaptation of the LPC values 324 when the wind buffet detector indicates that no wind buffets are present in the speech signal x(n). Conversely, the decision logic circuit 850 may permit normal adaptation of the LPC values 324 when the wind buffet detector 846 indicates that wind buffets are present in the speech signal x(n). The LPC values 324 may be maintained at their prior values when wind buffet activity is not detected. That is, the adaptive filter coefficient processor 218 may not adapt or modify the LPC values 324 absent wind buffets.

Figure 9:
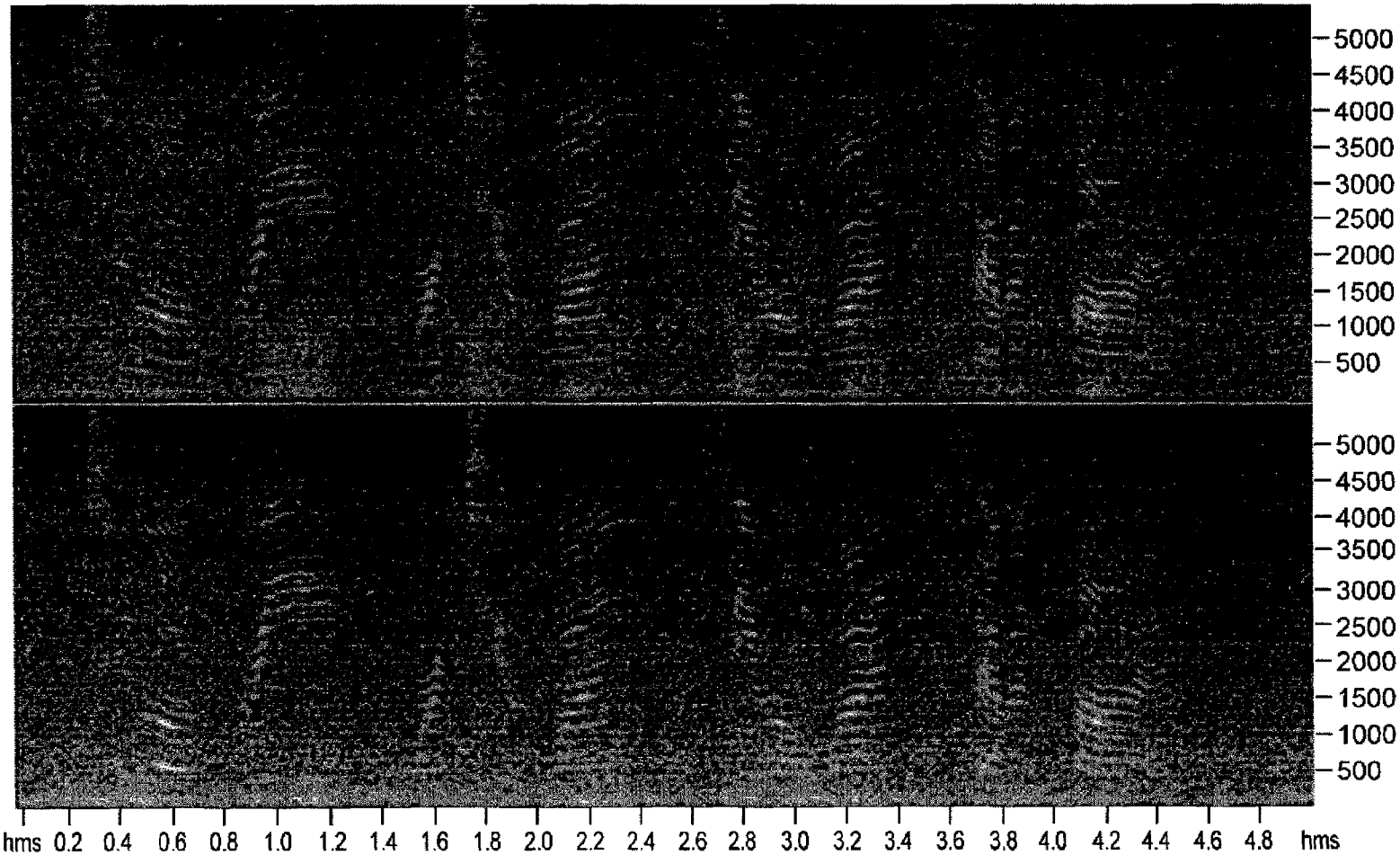
FIG. 9 is a spectrograph showing an unprocessed speech waveform in a lower panel. An upper panel shows the same waveform processed by the adaptive noise reduction system having a high-pass and low-pass filter.

FIG. 9 is a spectrograph showing a speech waveform in both upper and lower panels. The lower panel shows the speech signal in the presence of high-amplitude low-frequency wind buffet components. The upper panel shows the speech signal processed by the circuitry of FIG. 8. In FIG. 9, the amplitude of the wind buffet components has been significantly reduced.

The logic, circuitry, and processing described above may be encoded in a computer-readable medium such as a CD/ROM, disk, flash memory, RAM or ROM, an electromagnetic signal, or other machine-readable medium as instructions for execution by a processor. Alternatively or additionally, the logic may be implemented as analog or digital logic using hardware, such as one or more integrated circuits (including amplifiers, adders, delays, and filters), or one or more processors executing amplification, adding, delaying, and filtering instructions; or in software in an application programming interface (API) or in a Dynamic Link Library (DLL), functions available in a shared memory or defined as local or remote procedure calls; or as a combination of hardware and software.

The logic may be represented in (e.g., stored on or in) a computer-readable medium, machine-readable medium, propagated-signal medium, and/or signal-bearing medium. The media may comprise any device that contains, stores, communicates, propagates, or transports executable instructions for use by or in connection with an instruction executable system, apparatus, or device. The machine-readable medium may selectively be, but is not limited to, an electronic, magnetic, optical, electromagnetic, or infrared signal or a semiconductor system, apparatus, device, or propagation medium. A non-exhaustive list of examples of a machine-readable medium includes: a magnetic or optical disk, a volatile memory such as a Random Access Memory "RAM," a Read-Only Memory "ROM," an Erasable Programmable Read-Only Memory (i.e., EPROM) or Flash memory, or an optical fiber. A machine-readable medium may also include a tangible medium upon which executable instructions are printed, as the logic may be electronically stored as an image or in another format (e.g., through an optical scan), then compiled, and/or interpreted or otherwise processed. The processed medium may then be stored in a computer and/or machine memory.

The systems may include additional or different logic and may be implemented in many different ways. A controller may be implemented as a microprocessor, microcontroller, application specific integrated circuit (ASIC), discrete logic, or a combination of other types of circuits or logic. Similarly, memories may be DRAM, SRAM, Flash, or other types of memory. Parameters (e.g., conditions and thresholds), and other data structures may be separately stored and managed, may be incorporated into a single memory or database, or may be logically and physically organized in many different ways. Programs and instruction sets may be parts of a single program, separate programs, or distributed across several memories and processors. The systems may be included in a wide variety of electronic devices, including a cellular phone, a headset, a hands-free set, a speakerphone, communication interface, or an infotainment system.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A noise suppression system comprising:

a sampling circuit adapted to sample an audio input signal at a predetermined sampling rate;

a low-pass filter coupled with the sampling circuit and configured to pass low-frequency components of the sampled audio input signal;

a plurality of delay circuits configured to sequentially delay the low-frequency components of the sampled audio input signal to provide sequentially delayed signals;

an adaptive processor configured to process the sequentially delayed signals and update a plurality of linear predictive coefficient (LPC) values on a sample-by-sample basis, based on an error signal, where the error signal is based on a difference between an output of the low-pass filter and an output of the adaptive processor; and a decision logic device coupled with the adaptive processor and configured to inhibit an update of the LPC values applied to a portion of the sampled audio input signal based on a determination that a wind buffet is not present in the portion of the sampled audio input signal;

a high-pass filter coupled with the sampling circuit and configured to pass high-frequency components of the sampled audio input signal; and an adder configured to sum the error signal and an output of the high-pass filter to generate an output signal.

2. The system of claim 1, further comprising a conversion circuit configured to convert the output signal to an analog signal as an enhanced output signal having reduced low-frequency components.

3. The system of claim 1, where between 2 and 20 LPC values are updated on a sample-by-sample basis.

4. The system of claim 1, where the error signal represents enhanced sampled audio speech.

5. The system of claim 4, where noise components of the enhanced sampled audio speech are normalized in amplitude, and an average amplitude of the noise components is reduced.

6. The system of claim 1, further comprising a voice activity detector coupled with the decision logic device and configured to detect a presence of a speech signal, where the decision logic device is configured to inhibit updating of the LPC values applied to the speech signal in response to the detected presence of the speech signal.

7. The system of claim 6, where the detection of the speech signal is based on an average energy level of the sampled audio input signal.

8. The system of claim 1, where the low-pass filter passes low-frequency components of the sampled audio input signal to the adaptive processor, and blocks higher-frequency components of the sampled audio input signal.

9. The system of claim 8, where the low-frequency components are flattened in amplitude.

10. The system of claim 1, further comprising a wind buffet detector coupled with the decision logic device and configured to detect whether the wind buffet is present in the portion of the sampled audio input signal, where the decision logic device is configured to inhibit adaptation of the LPC values in response to a determination by the wind buffet detector that the wind buffet is not present.

11. A noise suppression system comprising:

a sampling circuit adapted to sample an input signal at a predetermined sampling rate;

a low-pass filter coupled with the sampling circuit and configured to pass low-frequency components of the sampled input signal;

an adaptive processor coupled with the low-pass filter and configured to update a plurality of linear predictive coefficient (LPC) values on a sample-by-sample basis, based on an error signal;

where the error signal is based on a difference between an output of the low-pass filter and an output of the adaptive processor, and where the LPC values are configured to flatten the error signal across a frequency region of interest to provide the error signal as an enhanced speech signal having reduced low-frequency components;

a wind buffet detector configured to detect whether wind buffets are present in the sampled input signal;

a decision logic device coupled with the wind buffet detector and configured to inhibit adaptation of the LPC values in response to a determination by the wind buffet detector that a wind buffet is not present in the sampled input signal;

a high-pass filter coupled with the sampling circuit and configured to pass high-frequency components of the sampled input signal; and an adder configured to sum the error signal and an output of the high-pass filter to generate an output signal.

12. The system of claim 11, where the adaptive processor loosely models a human vocal tract.

13. The system of claim 11, where the error signal represents enhanced sampled speech.

14. A method for enhancing a signal provided to a user device, the method comprising:

sampling an audio input signal at a predetermined sample rate;

filtering the sampled audio input signal through a low-pass filter to pass low-frequency components of the sampled audio input signal;

delaying the low-frequency components of the sampled audio input signal by multiple levels of delays to provide sequentially delayed signals;

processing the sequentially delayed signals in an adaptive filter;

adaptively updating linear predictive coefficient (LPC) values on a sample-by-sample basis based on an error signal, where the error signal is based on a difference between an output of the low-pass filter and an output of the adaptive filter;

determining whether a portion of the sampled audio input signal includes wind buffets;

inhibiting an update of the LPC values applied to the portion of the sampled audio input signal in response to a determination that the portion of the sampled audio input signal does not include a wind buffet;

filtering the sampled audio input signal through a high-pass filter to pass high-frequency components of the sampled audio input signal; and adding the error signal and an output of the high-pass filter to generate an output signal.

15. The method according to claim 14 further comprising converting the output signal to an analog signal and outputting the analog signal as an enhanced signal to the user device.

16. The method according to claim 14, where the adaptive filter loosely models a human vocal tract.

17. The method according to claim 14, where the low-pass filter passes low-frequency components of the sampled audio input signal to the adaptive filter, and blocks higher-frequency components of the sampled audio input signal.

18. The method according to claim 17, where the low-frequency components are flattened in amplitude.

19. A non-transitory computer-readable storage medium having processor executable instructions to provide a noise-reduced signal by performing the acts of:

sampling an audio input signal at a predetermined sample rate;

filtering the sampled audio input signal through a low-pass filter to pass low-frequency components of the sampled audio input signal;

delaying the low-frequency components of the sampled audio input signal by multiple levels of delays to provide sequentially delayed signals;

processing the sequentially delayed signals in an adaptive filter;

adaptively updating linear predictive coefficient (LPC) values on a sample-by-sample basis based on an error signal, where the error signal is based on a difference between an output of the low-pass filter and an output of the adaptive filter;

determining whether a portion of the sampled audio input signal includes wind buffets;

inhibiting an update of the LPC values applied to the portion of the sampled audio input signal in response to a determination that the portion of the sampled audio input signal does not include a wind buffet;

filtering the sampled audio input signal through a high-pass filter to pass high-frequency components of the sampled audio input signal; and adding the error signal and an output of the high-pass filter to generate an output signal.

* * * * *